US005715847A

United States Patent [19]

Rolf et al.

[11] Patent Number: 5,715,847

[45] Date of Patent: Feb. 10, 1998

[54] HAIR STYLING IMPLEMENT

[75] Inventors: Wilfried Rolf, Runkel-Eschenau; Dieter Liebenthal, Maintal, both of Germany

[73] Assignee: Braun Aktiengesellschaft, Frankfurt, Germany

[21] Appl. No.: 573,174

[22] Filed: Dec. 15, 1995

[30] Foreign Application Priority Data

Dec. 17, 1994 [DE] Germany ..... 64 45 237.3

[51] Int. Cl.[6] ..... A45D 20/12

[52] U.S. Cl. ..... 132/271; 132/129; 34/97

[58] Field of Search ..... 132/211, 107, 132/112, 271, 272, 129; 15/246.2, 344, 402, 405; 34/96, 97, 98

[56] References Cited

U.S. PATENT DOCUMENTS

| | | | |
|---|---|---|---|
| 3,981,313 | 9/1976 | Burke et al. | 34/97 |
| 4,525,623 | 6/1985 | Da Silva | 34/96 |
| 4,538,362 | 9/1985 | Andis | 34/97 |
| 4,604,514 | 8/1986 | Thaler et al. | 219/225 |
| 4,759,135 | 7/1988 | Scivoletto | 132/112 |
| 5,060,398 | 10/1991 | Wolens | 132/271 |
| 5,211,131 | 5/1993 | Plyler | 15/402 |
| 5,212,366 | 5/1993 | McDougall | 219/222 |
| 5,457,894 | 10/1995 | Dorber | 34/98 |
| 5,488,783 | 2/1996 | Parkinson et al. | 34/98 |
| 5,604,985 | 2/1997 | Andis et al. | 30/132 |

FOREIGN PATENT DOCUMENTS

| | | | |
|---|---|---|---|
| 439781 | 8/1991 | European Pat. Off. | 34/96 |
| 2 446 615 | 8/1980 | France . | |
| 4227 845 A1 | 3/1993 | Germany . | |
| 93 05 195.6 | 7/1993 | Germany . | |
| 2211732 | 7/1989 | United Kingdom | 34/96 |
| 2 259 007 | 11/1994 | United Kingdom . | |
| WO 93/09693 | 5/1993 | WIPO . | |

*Primary Examiner*—Todd E. Manahan
*Attorney, Agent, or Firm*—Edward S. Podszus

[57] ABSTRACT

The invention is directed to a hair styling implement adapted to be attached to an air outlet opening of a hair dryer and equipped with a housing and a plurality of hair pickup elements and an adjusting element that is movable relative to the housing. In this arrangement, at least one locking member is provided which is adapted to be located in at least two positions; in a first position, the adjusting member is lockable with the housing, and in a second position in which the hair styling implement is attached to the dryer, the housing is lockable with the hair dryer.

38 Claims, 6 Drawing Sheets

HAIR STYLING IMPLEMENT

BACKGROUND OF THE INVENTION

This invention relates to a hair styling implement adapted to be attached to an air outlet opening of a hair dryer, with a housing and with a plurality of hair pickup elements and an adjusting means that is movable relative to the housing.

DISCUSSION OF THE PRIOR ART

An implement of this type is known, for example, from PCI International Application WO 93/09693. This specification describes a diffuser for a hair dryer comprising a diffuser body adapted to be attached to the air outlet opening of a hair dryer. The diffuser includes a plurality of hair pickup elements extending away from the diffuser body, in particular parallel to the direction of flow through the diffuser. In this arrangement, at least one of the hair pickup elements is mounted on the diffuser body so as to be movable relative to the other hair pickup elements.

In use, the ends of the hair pickup elements of the diffuser attached to a hair dryer are positioned against the user's head, resting—at least in part—on the scalp. During use of the diffuser, the hair pickup elements are immersed in the hair such as to cause the hair to separate into individual strands arranging themselves between the hair pickup elements. As a result of the user subsequently moving at least one hair pickup element relative to the remaining elements, the individual strands of hair lying between the movable hair pickup element and the adjacent immovable hair pickup elements are shaped in the form of a curl, a wave or some other bent configuration, to be exposed to the air stream discharged from the diffuser.

In consequence, the strands of hair trapped between the hair pickup elements and shaped by reason of the displacement of the at least one hair pickup element are dried by means of this diffuser and worked into a curly or wavy style.

It is known from the art to attach a diffuser or the like to the hair dryer by means of a bayonet-type securement means. To this end, a plurality of circumferentially spaced projections are provided in the air inlet area of the diffuser. Recesses registering with the projections are provided at the air outlet opening of the hair dryer for potential locking engagement with the projections on the diffuser.

SUMMARY OF THE INVENTION

It is an object of the present invention to provide a hair styling implement which affords greater ease of manipulation than does the known device and ensures a safe use of the implement.

This object is essentially accomplished in a hair styling implement of the type initially referred to in that at least one locking means is provided which is adapted to be located in at least two positions, wherein the adjusting means is adapted to be locked with the housing in a first position of the locking means. In this arrangement, the adjusting means may be configured, for example, as a rotary ring structure concentrically encompassing the outside of the housing and connected with at least one hair pickup element. By reason of the locking means it is accomplished that the adjusting means, that is, the rotary ring structure, is suitable for locking engagement with the housing of the implement for attaching and/or removing the hair styling implement to or from the air outlet opening of a hair dryer. As a result, the adjusting means is advantageously fixed in place with respect to the housing of the hair styling implement, accordingly eliminating the need to rotate the adjusting means into a stop position—for example, at the end of the range of rotation of the adjusting means—as the hair styling implement is attached or removed. The user is thus in a position to hold the implement by the adjusting ring, introducing the implement into the air outlet opening of the hair dryer in order to lock the bayonet-type securement means. In this arrangement, the hair styling implement may be configured as a diffuser or, alternatively, as a nozzle.

Further, a user may set and dry the hair curl or wave obtained by rotation of the hair pickup elements relative to each other. A still further advantage of the present invention is that, prior to the use of the hair styling implement, all of the hair pickup elements connected with the adjusting means are adapted to be located in one position. This enables the implement to be used in a further manner in which the hair pickup elements are positioned against the user's head, a movement of the hair pickup elements with respect to the head causing the hair to be caught, to ride up between the hair pickup elements and to be lifted in the direction of the air outlet opening, thus maintaining root lift and volume in the user's hair.

In a further solution, the hair styling implement of the type initially referred to is improved such that at least one locking means is provided which is adapted to be located in at least two positions, wherein the housing of the hair styling implement attached to the hair dryer is adapted to be locked with the hair dryer in a second position of the locking means. This is particularly beneficial for ensuring a safe use of the hair styling implement, because it is fixedly connected with the hair dryer, preventing an inadvertent detachment of the implement from the hair dryer in use.

In use of the appliance, it is thus possible and desirable for a user to rotate the adjusting means relative to the housing of the hair styling implement. This is readily possible up to a stop at the housing of the implement. However, if the user rotates the adjusting means beyond the stop, this has the effect of the adjusting moving the housing relative to the hair dryer until the bayonet-type securement means provided between the housing of the hair styling implement and the hair dryer opens. As soon as this bayonet-type securement means is open, safe use of the appliance is no longer warranted, since this then involves the risk of the implement becoming accidentally detached from the hair dryer and one of the two parts falling to the ground. This is advantageously avoided in that the housing is adapted to be fixed to the hair dryer by means of the locking In a particularly advantageous and highly preferred embodiment, the adjusting means is locked or fixed with the housing in the first position of the sole locking means, while the housing is locked or fixed with the hair dryer in the second position.

In an advantageous configuration of the present invention, the locking means is arranged such as to be displaceable substantially parallel to the direction of flow through the housing. This affords the advantage of ease of manipulation, enabling the user to actuate the locking means with one finger of the hand gripping the implement. Because the adjusting means, that is, the rotary ring structure, is customarily provided at the air exit end of the hair styling implement, the direction of displacement of the locking means as herein proposed further allows an ideal combination of the two locking functions proposed in the foregoing.

In a further configuration of the present invention, the locking means is guided on the outside of the housing of the hair styling implement. The beneficial effects thereby achieved include ease of assembly of the locking means on the housing as well as good accessibility and ease of handling for its user.

Because the locking means has recesses on its rear side close to the housing, and the housing has corresponding detent cams on its outside, the locking means may be advantageously located in a variety of positions with respect to the housing.

In a still further advantageous configuration of the present invention, a cavity into which the locking means extends is provided between the housing of the hair styling implement and the adjusting means. This protects the user from the effect of temperature, because the adjusting means to be gripped by the user's hand is thermally decoupled from the housing exposed to the hot air stream. In addition, the cavity offers a possibility of concealing the locking means in part.

In a particular configuration, the locking means has at least one end thereof one or several detent means, in particular teeth, cams or the like. This affords the advantage of enabling the locking means to be manufactured with ease and as a one-piece construction, being formed, for example, from a plastics material.

In another advantageous configuration of the present invention, the adjusting means has on its inside close to the housing a plurality of in particular circumferentially equidistant recesses. This affords equally ease of manufacture and assembly, in particular at a concealed location not visible to the user's eyes. It will be understood, of course, that it is within the scope of a person skilled in the art to arrange the detent means on the adjusting means and the registering recesses on the locking means.

In a particularly advantageous configuration 6*f* the present invention, the adjusting means, that is, the rotary ring structure, is provided such as to be infinitely variable with respect to the locking means secured to the housing. By virtue of the connection of the rotary ring structure with at least one hair pickup element or a cluster of such elements, the rotary ring structure is advantageously infinitely variable within an adjustment range predetermined by the design.

In a still further configuration of the present invention, it is proposed to arrange for the detent means to lockingly engage with the corresponding recesses essentially in a radial direction with respect to the housing. As a result, a reliable locking engagement of the detent means within the recesses is accomplished with a small amount of displacement of the locking means in a direction essentially parallel to the direction of flow through the housing.

In a further advantageous configuration of the present invention, the locking means has a nose-shaped projection at its end pointing towards the hair dryer. Advantageously, this projection may be made integrally with the locking means, enabling the locking means to effect a second locking function as soon as the locking means is displaced in the direction of the projection.

In a particular configuration of the present invention, the nose-shaped projection of the locking means is suitable for locking engagement with a recess at the air outlet opening of the hair dryer. This has the advantageous effect of enabling the hair styling implement to be locked in place on the hair dryer, the projection causing the bayonet-type securement means to be locked.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summarization in the claims and their back-references.

In the drawings shown by way of example,

DETAILED DESCRIPTION OF EMBODIMENTS

Figure 1:
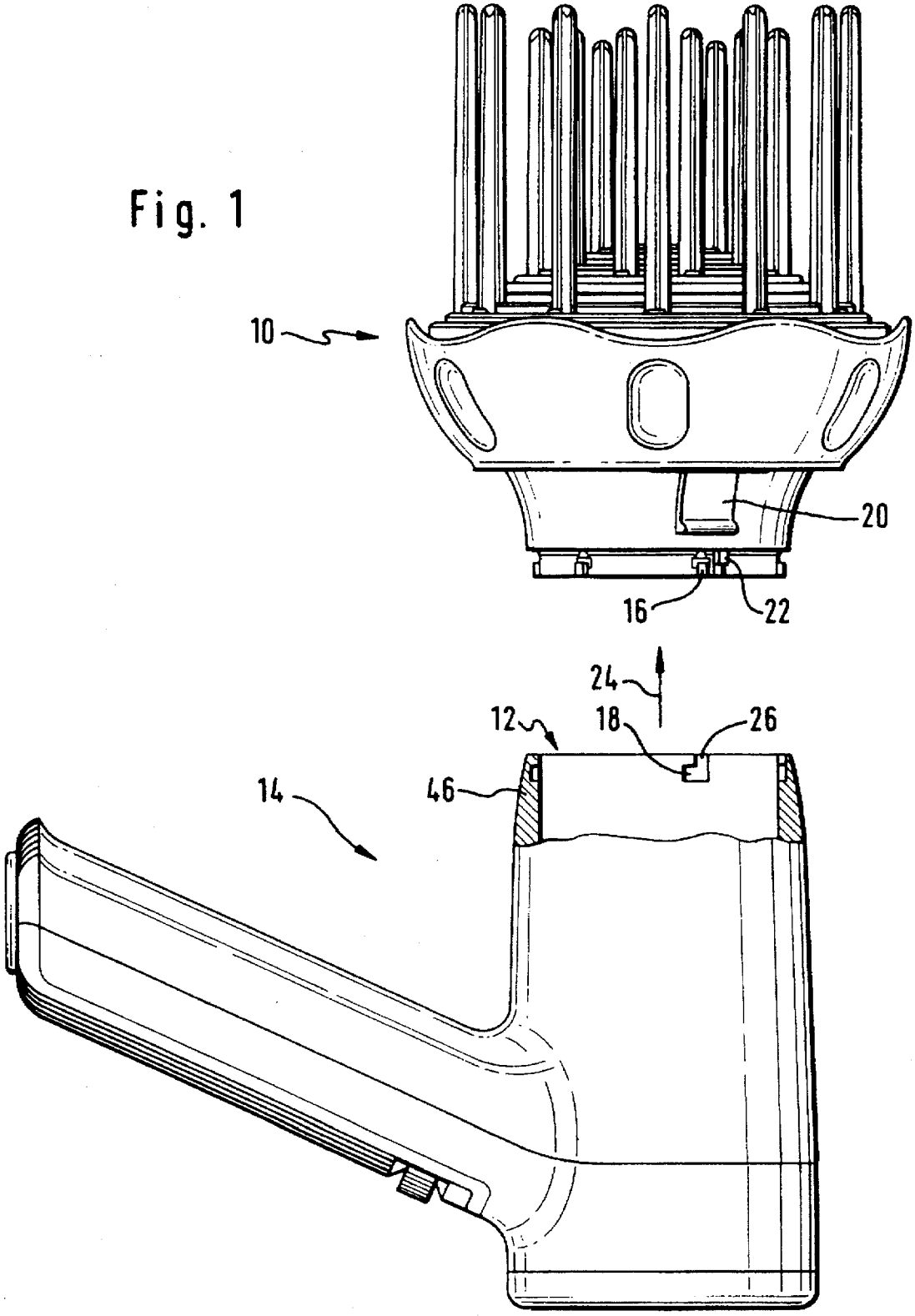
FIG. 1 is a schematic illustration of the hair styling implement and the hair dryer.

In the Figures, there is shown by way of example a hair styling implement suitable for attachment to an air outlet opening of a hair dryer. It will be understood that it is, of course, also possible and advantageous to contemplate another embodiment in which a hair styling implement is integrally formed with a hair dryer, thus providing an independently manipulatable hair care appliance having other application possibilities.

The hair styling implement 10 is adapted to be seated upon the air outlet opening 12 of the hair dryer 14. In the process, the nose-shaped projections 16 at the air inlet end of the implement 10 are pushed into the recesses 18 of the hair dryer 14. Using a rotating motion of the hair styling implement 10 relative to the hair dryer 14, the projections 16 become locked within the recesses 18, thus providing a bayonet-type connection.

In order to prevent the implement 10 from detaching itself from the dryer 14 inadvertently, the implement 10 is provided with a locking means 20 having a projection 22 thereon. Following insertion and rotation of the implement 10 relative to the dryer 14, the locking means 20 can be displaced in opposition to the direction of flow 24. The projection 22 on the locking means 20 thereby blocks the slot 26 for insertion of the projection 16.

A hair styling implement 10 (FIG. 2) is essentially comprised of a bell-shaped housing 28 into which an outer ring 30 and an inner ring 32 are insertable, each ring being equipped with a cluster of hair pickup elements 31. A locking means 20 is provided on the outside of the housing 28. The housing 28 is subsequently fitted into the essentially annular adjusting means 34.

The inner ring 32 is clipped onto the housing 28 in such a manner that this assembly, following seating engagement of the implement 10 with a dryer, is fixedly connectable therewith. By contrast, the outer ring 30 is clipped onto the adjusting means 34 so that on actuation of the adjusting means 34 by a user the hair pickup elements 31 mounted on the outer ring 30 are rotatable relative to the hair pickup elements 31 mounted on the inner ring 32. It will be understood, of course, that it is also possible for the outer ring 30 to be fixedly connected with the housing 28, the inner ring 32 being then rotatable with the adjusting means 34.

The locking means 20 has at one end thereof a plurality of tooth-shaped detent means 36. At its other end pointing in the direction of the hair dryer, the locking means 20 is provided with a nose-shaped projection 22. A recessed grip 38 is provided on the locking means 20 on the front side thereof pointing in the direction of the user.

The adjusting means 34 has on its inside a plurality of equidistant recesses 40 for potential engagement with the detent means 36 of the locking means 20.

Figure 2:
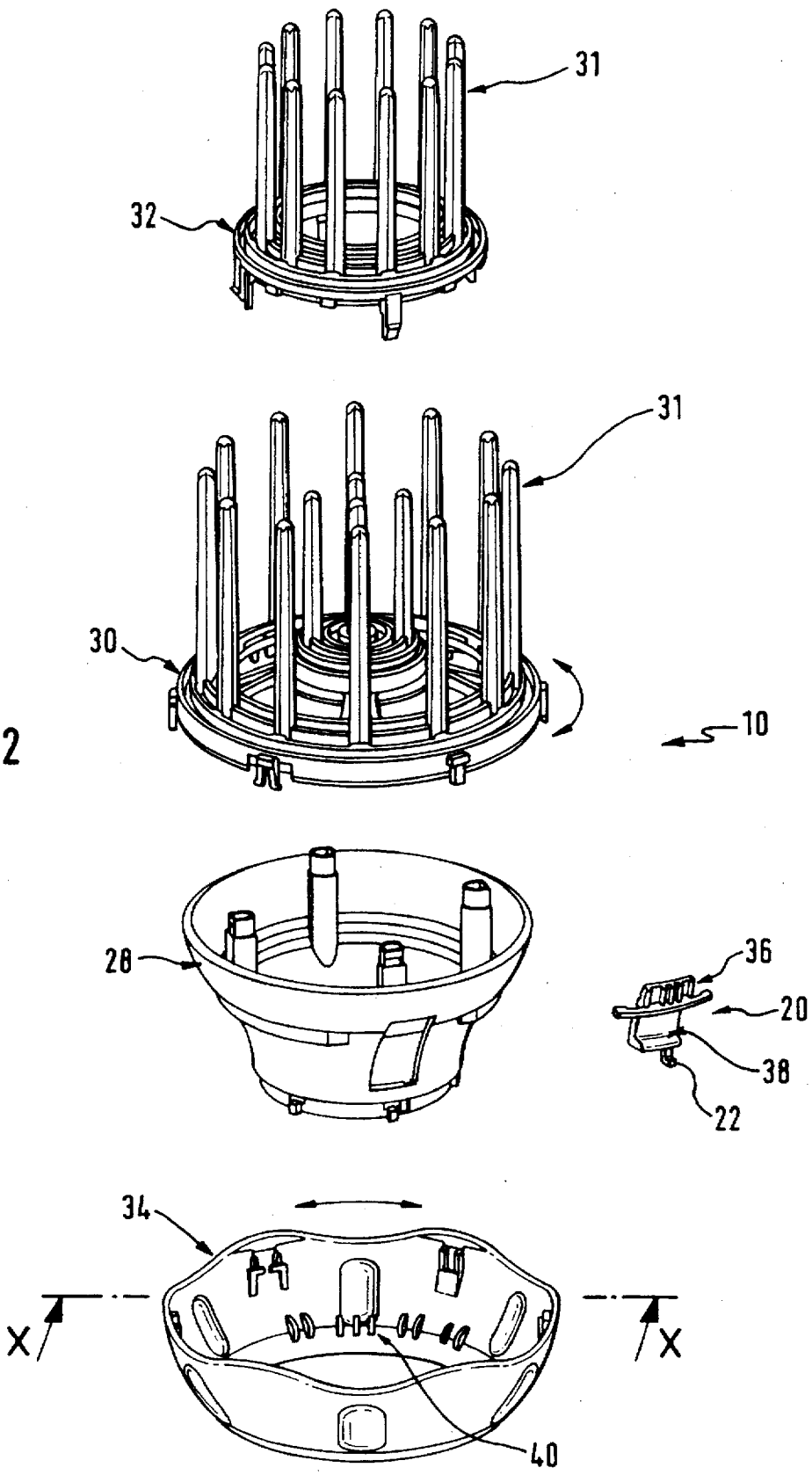
FIG. 2 is an exploded perspective view of a hair styling implement.
Figure 3A:
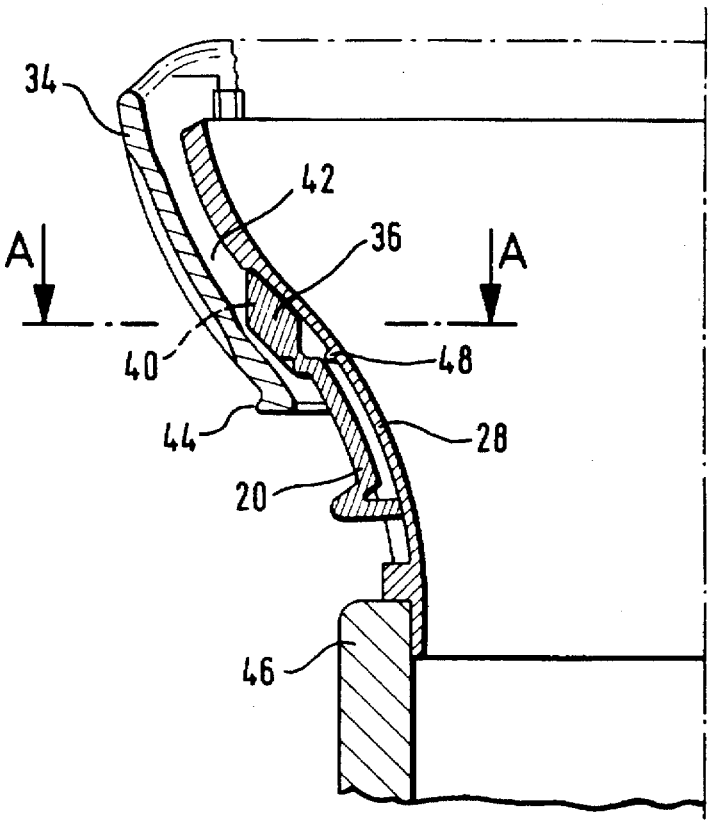
FIG. 3A is a schematic view in half-section, similar to the line X—X of FIG. 2, of a hair styling implement having its adjusting means in locking engagement with the housing.

FIG. 3A shows a section similar to the section X—X of FIG. 2, with only the left-hand half illustrating schematically the locking means 20 and the adjusting means 34. The locking means 20 being shown in the upper stop position, the detent means 36 of the locking means 20 engage within the recesses 40 of the adjusting means 34.

The adjusting means 34 configured as a ring is arranged at the air exit end of the housing 28. Between the housing 28 exposed to the flow of hot air and the adjusting means 34 to be gripped by the user's hand, there is provided a cavity 42 in order to thermally decouple the two aforementioned components. This avoids user contact with the hot areas of the implement. To prevent the possibility of the user's hand slipping from the adjusting means 34 in the direction of the hair dryer, a circumferential bead 44 is provided at the upstream end of the adjusting means 34.

Figure 3B:
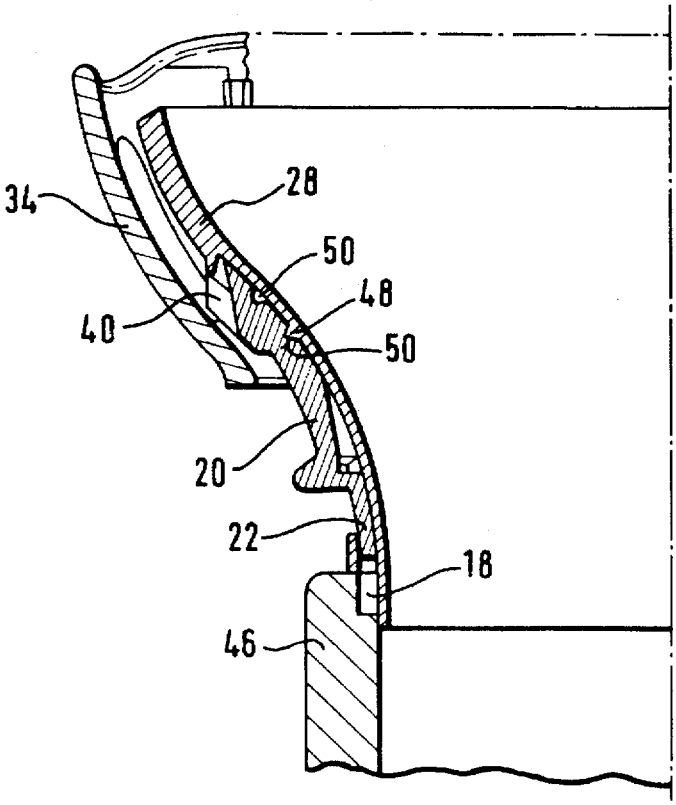
FIG. 3B is a view as in FIG. 3A, but in a relatively offset cutting plane.

FIG. 3B is a view substantially similar to that of FIG. 3A, but with the cutting plane slightly offset relative to the representation of FIG. 3A, so that in this Figure the locking means 20 and the flank of the recess 40 can be recognized. The locking means 20 is equally shown in the upper stop position, so that the detent cams 48 of the housing 28 are in locking engagement with the corresponding recesses 50 of the locking means 20. The projection 22 of the locking means 20 is likewise outside the recess 18 in the wall 46 of the hair dryer. The bayonet-type securement means, not shown in this Figure, between the housing 28 and the wall 46 of the hair dryer is thus not yet secured in place by the projection 22 of the locking means 20.

Figure 4A:
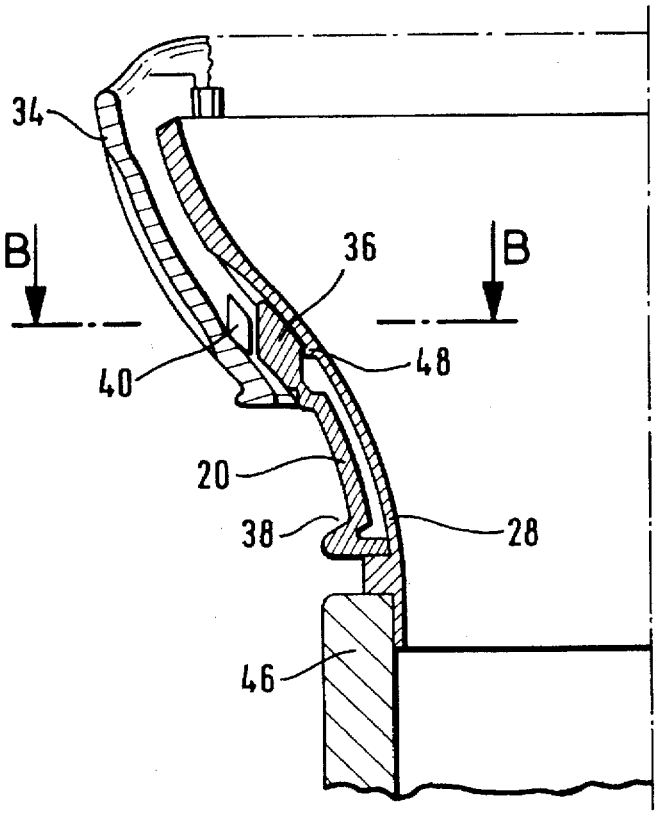
FIG. 4A is a schematic sectional and half-sectional view, similar to the line X—X of FIG. 2, of a hair styling implement having its housing in locking engagement with the hair dryer.
Figure 4B:
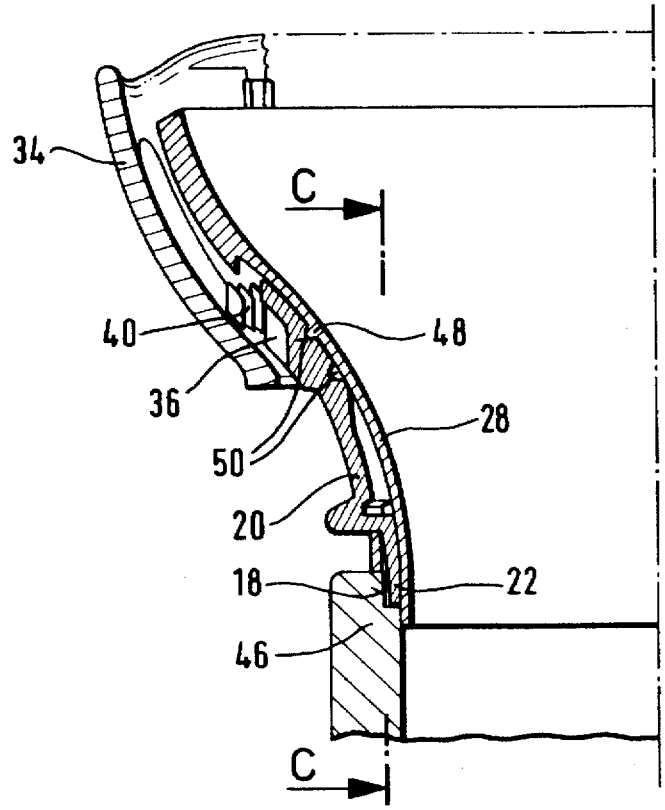
FIG. 4B is a view as in FIG. 4A, but in a relatively offset cutting plane.

FIGS. 4A and 4B show each the locking means 20 in a lower-most position in which it is in locking engagement with the wall 46 of the hair dryer. The detent means 36 of the locking means 20 are not in contact with the recesses 40 of the adjusting means 34. As a result, the annular adjusting means 34 is freely rotatable relative to the housing 28. In this position, a user may engage the hair to be styled in the space between the hair pickup elements, curling or waving it by means of the adjusting means 34.

FIG. 4B is a view similar to that of FIG. 4A, but in a different cutting plane, so that in this Figure the detent cam 48 of the housing 28 is in locking engagement within the dish-shaped recess 50 of the locking means 20. The projection 22 of the locking means 20 is inserted into the recess 18 in the wall 46 of the hair dryer.

Figure 5:
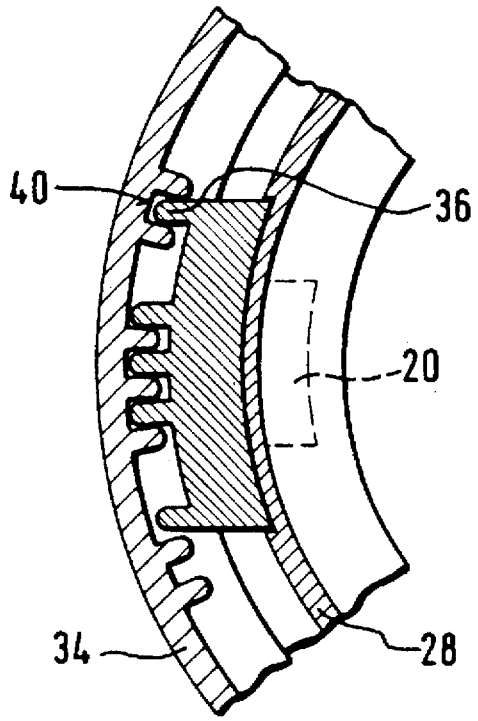
FIG. 5 is a partial sectional view, taken along the line A—A of FIG. 3A, of a locking means and an adjusting means in the engaged position.

FIG. 5 shows a fragmentary sectional view, taken along the line A—A of FIG. 3A. The locking means 20 includes, for example, a plurality of detent means 36 resembling the teeth of a comb and arranged on a circular-arc segment in a radially outwardly extending direction. These detent means 36 engage within the recesses 40 on the adjusting means 34 arranged at cooperating distances to the detent means 36. In the engaged position shown, a rotation of the adjusting means 34 relative to the locking means 20, and thus also relative to the housing 28, is prevented from occurring.

Figure 6:
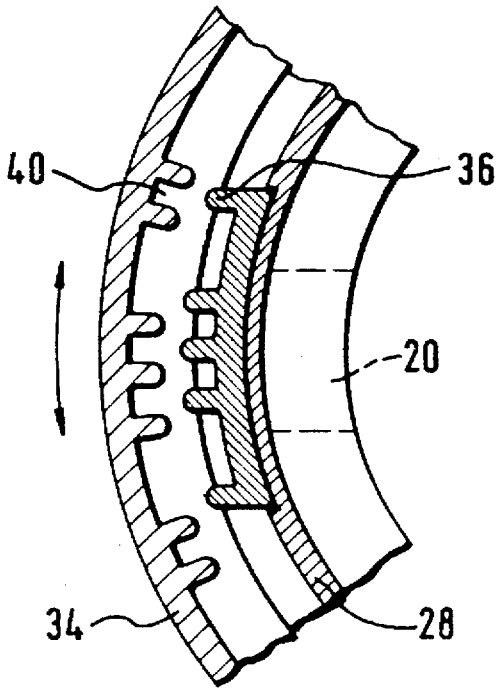
FIG. 6 is a partial sectional view, taken along the line B—B of FIG. 4A, of a locking means and an adjusting means in the disengaged position.

FIG. 6 shows a section taken along the line B—B of FIG. 4A. In this Figure, the detent means 36 of the locking means 20 are shown at a radial distance relative to the recesses 40 of the adjusting means 34. This thus enables a free and infinitely variable rotary motion of the adjusting means 34 relative to the locking means 20 and thus also relative to the housing 28. As a result, the adjusting means 34 can be rotated about the housing 28 within an angle of rotation predetermined by the design, until a new cluster of recesses 40 is moved up to the detent means 36 for potential locking engagement therewith.

Figure 7:
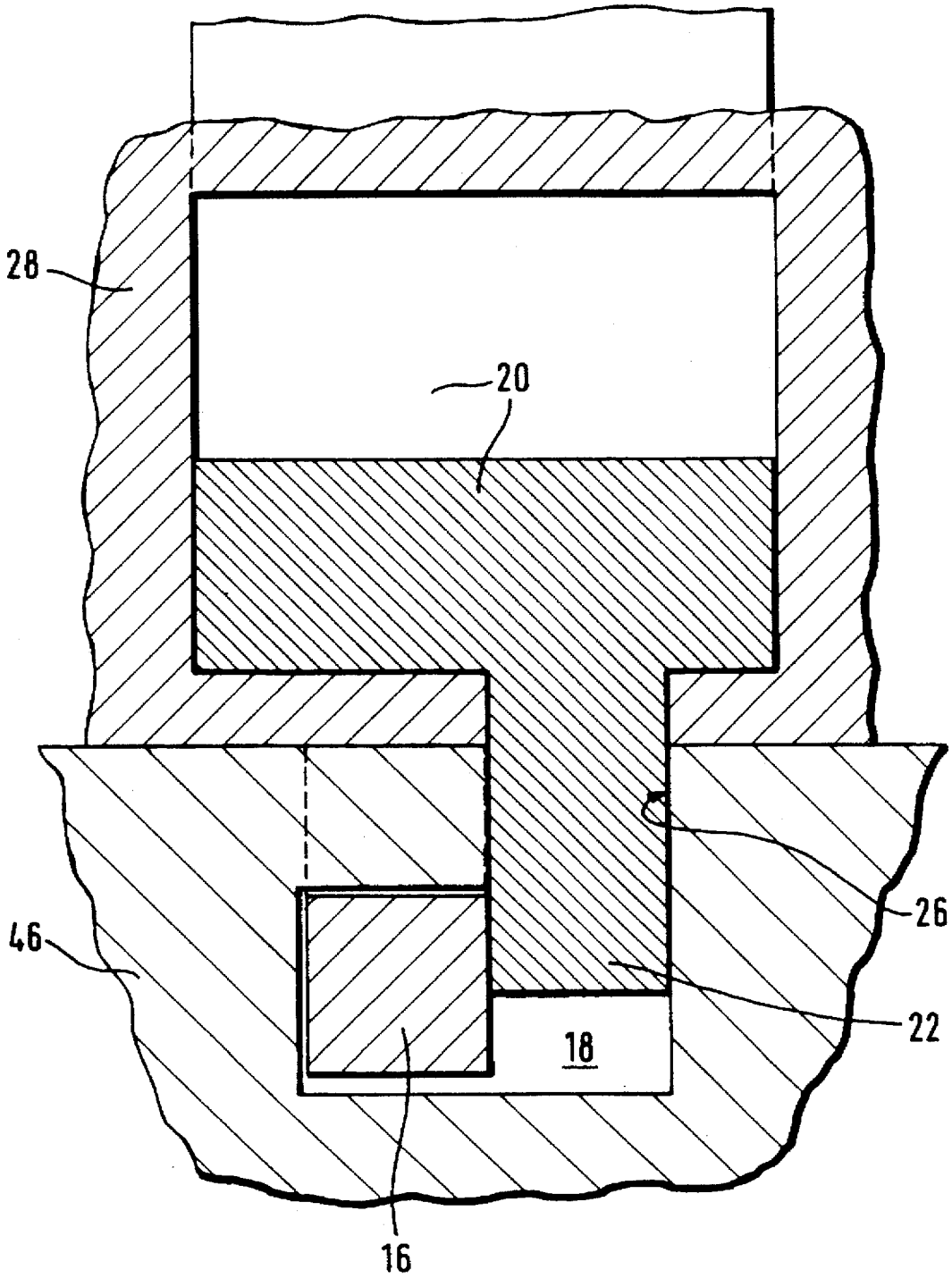
FIG. 7 is a developed and enlarged view of a locking means, sectioned along the line C—C of FIG. 4B.

FIG. 7 shows a section of the projection 22 of the locking means 20, taken along the line C—C of FIG. 4B. An L-shaped recess 18 is provided on the upper side of the wall 46 of the hair dryer. The housing 28 is seated down on the upper side, locking with a hook-shaped projection 16 thereof into the recess 18 in the manner of a bayonet-type securement means. The nose-shaped projection 22 of the locking means 20 is then inserted into the slot 26 of the recess 18, thereby locking the slot 26 against inadvertent detachment of the projection 16, and thus of the housing 28 of the hair styling implement, from the hair dryer.

We claim:

1. A hair styling implement adapted to be attached to a hair treatment part of a hair styling appliance, wherein the implement comprises a body housing element, a coupling means provided on the body housing element adapted to releasably attach the implement to the hair styling appliance, a body adjustment element that is moveable relative to the body housing element, and a locking means provided on a surface of one of the body elements and an engaging means provided on a surface of the other of the body elements, wherein the locking means is moveable between a first position wherein the locking means engages the engaging means and a second position wherein the locking means does not engage the engaging means, whereby in the first position the body adjustment element is not moveable relative to the body housing element.

2. A hair styling implement as claimed in claim 1 further comprising hair pickup elements disposed on at least one of the body elements.

3. A hair styling implement as claimed in claim 1 further comprising hair pickup elements disposed on the body housing element and on the body adjustment element.

4. A hair styling implement as claimed in claim 1 wherein the locking means comprises detents and the engaging means comprises recesses.

5. A hair styling implement as claimed in claim 1 wherein the locking means is provided on the body housing element and the engaging means is provided on the body adjustment element.

6. A hair styling implement as claimed in claim 1 wherein the locking means is provided on an outside surface of the body housing element and the engaging means is provided on an inside surface of the body adjustment element.

7. A hair styling implement as claimed in claim 1 wherein the locking means comprises at least one latching recess on a side adjacent the surface of the one of the body elements and the one of the body elements further comprises at least one detent cam cooperating with the latching recess, whereby the locking means is releasably latchable in at least one of the first or second positions.

8. A hair styling implement as claimed in claim 1 wherein the body housing element and the body adjustment element are in a spaced relation defining a cavity therebetween and the locking means is disposed in the cavity.

9. A hair styling implement as claimed in claim 1 wherein a plurality of the engaging means are disposed in spaced relation on the surface of the other of the body elements.

10. A hair styling implement as claimed in claim 1 wherein the body adjustment element is infinitely variable relative to the locking means.

11. A hair styling implement as claimed in claim 1 wherein the body adjustment element is infinitely variable relative to the body housing element.

12. A hair styling implement as claimed in claim 1 wherein the locking means comprises at least one detent engageable with the engaging means, wherein the at least one detent is selected from the group of objects consisting of teeth, cams and knobs.

13. A hair styling implement as claimed in claim 12 wherein the engaging means comprises a plurality of recesses spaced in equidistant relation on the surface of the other of the body elements.

14. A hair styling implement as claimed in claim 12 wherein the at least one detent is lockingly engageable with the engaging means in a direction radial to a longitudinal axis of the body housing element.

15. A hair styling implement as claimed in claim 1 wherein the hair styling appliance is an air-moving appliance for personal use and the hair treatment part is an air outlet opening of the air-moving appliance, wherein the hair styling implement further comprises an air inlet channel for receiving an air stream, said air inlet channel defining an air inlet opening and having a first principal axis generally perpendicular said inlet opening.

16. A hair styling implement as claimed in claim 15 further comprising hair pickup elements disposed on at least one of the body elements.

17. A hair styling implement as claimed in claim 15 wherein the hair styling implement comprises an air concentrator.

18. A hair styling implement as claimed in claim 15 wherein the hair styling implement comprises a diffusor.

19. A hair styling implement as claimed in claim 15 wherein the locking means is moveable in a direction parallel to the first principal axis.

20. A hair styling implement as claimed in claim 15 wherein the locking means is moveable in a direction at least partially transverse to a plane of the air inlet opening.

21. A hair styling implement as claimed in claim 15 wherein the hair styling implement further comprises an air exit opening and a principal air flow direction between the air exit and air inlet openings, and the locking means is moveable in a direction at least partially parallel to the principal air flow direction.

22. A hair styling implement releasably attached to a hair treatment part of a hair styling appliance, wherein the implement comprises a body housing element, a body adjustment element that is moveable relative to the body housing element, and a locking means provided on a surface of one of the body elements and wherein an engaging means is provided on a surface of the hair styling appliance, wherein the locking means is displaceable relative to the surface upon which it is provided and is moveable between a first position wherein the locking means does not engage the engaging means and a second position wherein the locking means engages the engaging means, whereby in the second position the one of the body elements is not moveable relative to the hair styling appliance.

23. A hair styling implement as claimed in claim 22 wherein the hair styling appliance is an air-moving appliance for personal use and the hair treatment part is an air outlet opening of the air-moving appliance.

24. A hair styling implement as claimed in claim 22 wherein the locking means is provided on the body housing element.

25. A hair styling implement as claimed in claim 22 wherein the locking means comprises a projection extending in a direction of the engaging means of the hair styling appliance.

26. A hair styling implement as claimed in claim 25 wherein the engaging means of the hair styling appliance comprises a recess and the projection is lockingly engageable with the recess.

27. A hair styling implement releasably attached to a hair treatment part of a hair styling appliance, wherein the implement comprises:

a body housing element attachable to the hair treatment part;

a body adjustment element that is moveable relative to the housing body element;

a locking means provided on a surface of one of the body elements; and an engaging means provided on a surface of the other of the body elements; and a housing engaging means is provided on the hair styling appliance, wherein the locking means is moveable between a first position wherein the locking means engages the engaging means and does not engage the housing engaging means and a second position wherein the locking means engages the housing engaging means and does not engage the engaging means, whereby in the first position the body adjustment element is not moveable relative to the body housing element and in the second position the body adjustment element is movable relative to the body housing element and the body housing element is not moveable relative to the hair styling appliance.

28. A hair styling implement as claimed in claim 27 wherein the hair styling appliance is an air-moving appliance for personal use and the hair treatment part is an air outlet opening of the air-moving appliance.

29. A hair styling implement as claimed in claim 27 wherein the locking means is provided on the body housing element and the engaging means is provided on the body adjustment element.

30. A hair styling implement as claimed in claim 27 further comprising hair pickup elements disposed on at least one of the body elements.

31. A hair styling implement as claimed in claim 27 wherein the locking means comprises detents and the engaging means comprises recesses.

32. A hair styling implement as claimed in claim 27 wherein the locking means is provided on an outside surface of the body housing element and the engaging means is provided on an inside surface of the body adjustment element.

33. A method of releasably securing a hair styling implement to an air outlet opening of an air-moving appliance, comprising the steps of:

providing an implement having a body housing element, a body adjustment element that is moveable relative to the body housing element, a locking means supported for motion on a surface of one of the body elements, a body engaging means provided on a surface of the other of the body elements, and a housing engaging means provided on the hair styling appliance;

attaching the body housing element to the air outlet opening;

moving the locking means to a first position;

engaging the locking means with the body engaging means while disengaging the locking means from the housing engaging means;

moving the locking means to a second position;

engaging the locking means with the housing engaging means while disengaging the locking means from the body engaging means, whereby in the first position the body adjustment element is not moveable relative to the body housing element and in the second position the body adjustment element is movable relative to the body housing element and the body housing element is locked relative to the hair styling appliance.

34. A method as claimed in claim 33 wherein the hair styling appliance is an air-moving appliance for personal use and the hair treatment part is an air outlet opening of the air-moving appliance.

35. A method as claimed in claim 33 wherein the step of providing further comprises providing the locking means on the body housing element and providing the body engaging means on the body adjustment element.

36. A method as claimed in claim 33 wherein the step of providing further comprises disposing hair pickup elements on at least one of the body elements.

37. A method as claimed in claim 33 wherein the step of providing further comprises providing the locking means with detents and the body engaging means with cooperating recesses.

38. A method as claimed in claim 33 wherein the step of providing further comprises providing the locking means with a projection extending in a direction of the housing engaging means of the hair styling appliance and providing the housing engaging means with a recess, and wherein the step of engaging the locking means with the housing engaging means further comprises lockingly engaging the projection with the recess.

* * * * *